US006239779B1

(12) United States Patent
Furuya et al.

(10) Patent No.: US 6,239,779 B1
(45) Date of Patent: May 29, 2001

(54) ACTIVE MATRIX TYPE LIQUID CRYSTAL DISPLAY APPARATUS USED FOR A VIDEO DISPLAY SYSTEM

(75) Inventors: Masato Furuya, Yokosuka; Tsutou Asakura, Odawara, both of (JP)

(73) Assignee: Victor Company of Japan, Ltd., Yokohama (JP)

( * ) Notice: Subject to any disclaimer, the term of this patent is extended or adjusted under 35 U.S.C. 154(b) by 0 days.

(21) Appl. No.: 09/262,803

(22) Filed: Mar. 4, 1999

(30) Foreign Application Priority Data

Mar. 6, 1998 (JP) ..... 10-073460
Mar. 16, 1998 (JP) ..... 10-084961

(51) Int. Cl.[7] ..... G09G 3/36
(52) U.S. Cl. ..... 345/87; 345/96
(58) Field of Search ..... 345/96, 94, 87, 345/84, 99

(56) References Cited

U.S. PATENT DOCUMENTS 4,842,371 * 6/1989 Yasuda et al. ..... 350/333
5,091,784 * 2/1992 Someya et al. ..... 358/183

FOREIGN PATENT DOCUMENTS 59-230378 12/1984 (JP) .

* cited by examiner

*Primary Examiner*—Bipin Shalwala
*Assistant Examiner*—Vanel Frenel
(74) *Attorney, Agent, or Firm*—Anderson, Kill & Olick P.C.

(57) ABSTRACT

A video signal of the non-interlaced scanning type is converted into a video signal of the interlaced scanning type by alternately selecting odd-number horizontal scanning line signals or even-number horizontal scanning line signals in synchronism with the start timing of each field period. The polarity of the video signal is inverted every vertical scanning period. During a first vertical scanning period, the odd-number video signal is written to respective sets of two neighboring line scanning electrodes (G1, G2), (G3, G4), (G5, G6), - - - . During a second vertical scanning period, the even-number video signal is written to another sets of two neighboring line scanning electrodes (G2, G3), (G4, G5), (G6, G7), - - - . The time axis of each horizontal scanning period is doubled. The drive frequency of a row signal electrode drive circuit is halved.

3 Claims, 10 Drawing Sheets

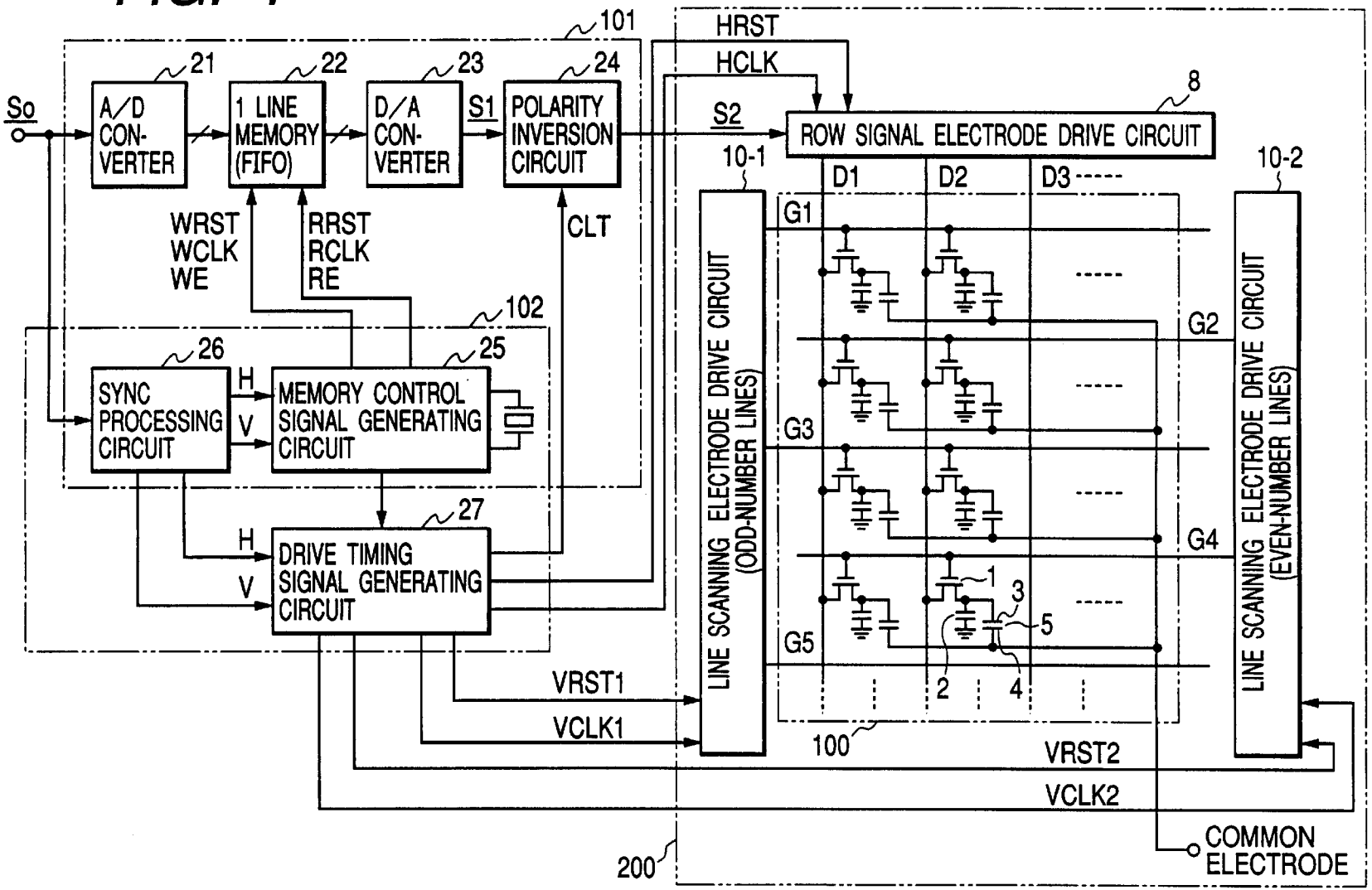
FIG. 1
So
A/D CON-VERTER
21
1 LINE MEMORY (FIFO)
22
D/A CON-VERTER
23
S1
POLARITY INVERSION CIRCUIT
24
CLT
101
WRST
WCLK
WE
RRST
RCLK
RE
102
SYNC PROCESSING CIRCUIT
26
H
V
MEMORY CONTROL SIGNAL GENERATING CIRCUIT
25
DRIVE TIMING SIGNAL GENERATING CIRCUIT
27
VRST1
VCLK1
VRST2
VCLK2
HRST
HCLK
S2
ROW SIGNAL ELECTRODE DRIVE CIRCUIT
8
D1
D2
D3
G1
G2
G3
G4
G5
LINE SCANNING ELECTRODE DRIVE CIRCUIT (ODD-NUMBER LINES)
10-1
LINE SCANNING ELECTRODE DRIVE CIRCUIT (EVEN-NUMBER LINES)
10-2
COMMON ELECTRODE
100
200
1
2
3
4
5

FIRST VERTICAL SCANNING PERIOD
(INPUT PERIOD OF FIRST FRAME)
SECOND VERTICAL SCANNING PERIOD
(INPUT PERIOD OF SECOND FRAME)
ONE HORIZONTAL SCANNING PERIOD
INPUT SIGNAL So
LINE MEMORY CONTROL
WRITING
READING
S1
S2
LINE SCANNING ELECTRODES
G1
G2
G3
G4
G5
G6
G7
(+)
(−)
1
2
3
4
5
2m−1
2m
6

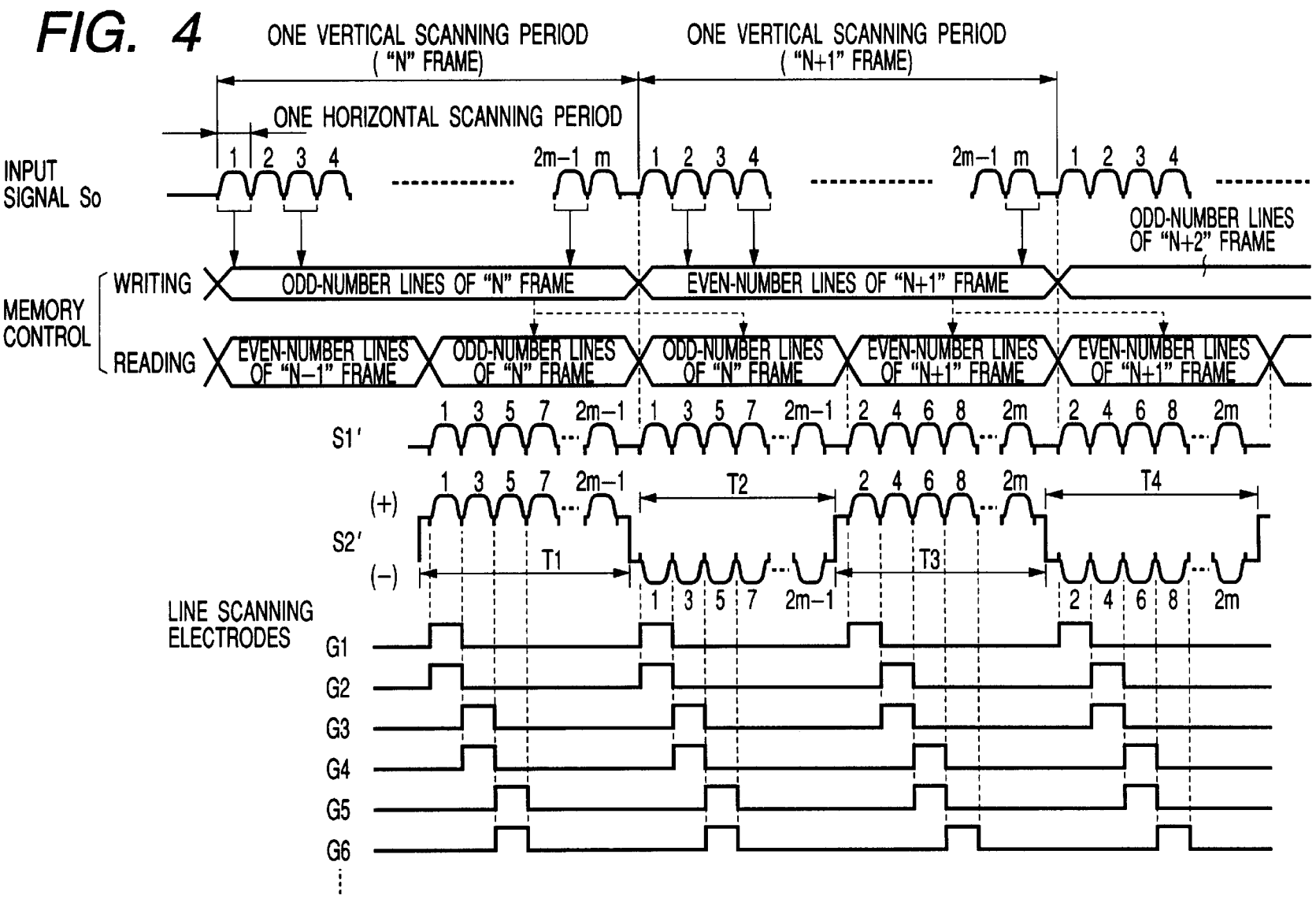
FIG. 4
INPUT SIGNAL So
MEMORY CONTROL
WRITING
READING
ONE HORIZONTAL SCANNING PERIOD
ONE VERTICAL SCANNING PERIOD ("N" FRAME)
ONE VERTICAL SCANNING PERIOD ("N+1" FRAME)
ODD-NUMBER LINES OF "N" FRAME
EVEN-NUMBER LINES OF "N+1" FRAME
ODD-NUMBER LINES OF "N+2" FRAME
EVEN-NUMBER LINES OF "N−1" FRAME
ODD-NUMBER LINES OF "N" FRAME
EVEN-NUMBER LINES OF "N+1" FRAME
S1'
S2'
(+)
(−)
T1
T2
T3
T4
LINE SCANNING ELECTRODES
G1
G2
G3
G4
G5
G6

Sig
HRST
HCLK
VST2
8
ROW SIGNAL ELECTRODE DRIVE CIRCUIT
D1
D2
D3
100
G1
G2
G3
G4
G5
G6
100a
10-2
10-1
VCLK
VCLK
COMMON ELECTRODE
VST1
300
36
b
a
VSTo
34
(N−1) STAGE
F
FF
D
33
35
32
FIELD JUDGING CIRCUIT
O/E
HD
VD
31
RC COUNTER
RST
VD
HD
103

ROW SIGNAL ELECTRODE DRIVE CIRCUIT
8
Sig
HRST
HCLK
D1
D2
D3
100
G1
G2
G3
G4
G5
G6
COMMON ELECTRODE
11-1
11-2
11-3
a
b
VST
VCLK
300'
104
34
(N−1) STAGE
FF
D
F
33
31
RC COUNTER
RST
HD
VD
32
FIELD JUDGING CIRCUIT
O/E

ACTIVE MATRIX TYPE LIQUID CRYSTAL DISPLAY APPARATUS USED FOR A VIDEO DISPLAY SYSTEM

BACKGROUND OF THE INVENTION

The present invention relates to an active matrix type liquid crystal display apparatus preferably applicable to a projection-type display system or a projector, and more particularly to an active matrix type liquid crystal display apparatus capable of suppressing a drive frequency in a row signal electrode drive circuit and realizing an excellent AC driving of the liquid crystal elements, thereby improving the quality in the liquid crystal video display. Furthermore, the present invention relates to an improvement of video display quality robust against adverse influence of the wiring resistance etc.

Conventionally, transmission-type liquid crystal display apparatuses are adopted in many of projection-type display systems and projectors. On the other hand, reflection-type liquid crystal display apparatuses have been recently used to attain a higher aperture rate under the severe requirement of high densification of pixels and also to realize higher resolution as well as higher brightness.

In both cases, improvement of the display quality and reduction of the costs are strictly required.

FIG. 8 shows a fundamental arrangement of a conventional active matrix type display apparatus employed in the transmission-type and reflection-type liquid crystal display apparatuses.

In FIG. 8, Di (i=1,2,3, - - - ) represents a plurality of row signal electrodes and Gj (j=1,2,3, - - - ) represents a plurality of line scanning electrodes. The row signal electrodes Di (i=1,2,3, - - - ) and the line scanning electrodes Gj (j=1,2,3, - - - ) are arranged in a matrix pattern on a substrate. An active element circuit, consisting of a switching transistor 1 and an auxiliary capacitor 2, is formed at respective intersections formed by the row signal electrodes Di and the line scanning electrodes Gj. A plane pixel electrode 3 is provided on each surface dissected by the row signal electrodes Di and the line scanning electrodes Gj. Each pixel electrode 3 is connected to a connecting point between the switching transistor 1 and the auxiliary capacitor 2 in each active element circuit. A liquid crystal orientation film (not shown) is provided on the upper surface of the pixel electrode 3.

The liquid crystal orientation film and a common electrode film 4 are provided on a glass substrate (not shown), which is positioned in a confronting relationship with the substrate for the above-described active elements. A liquid crystal 5 is sealed tightly in a clearance space between these opposed substrates, so as to form a light modulating section.

Each row signal electrode Di is driven by an analog switch 6-i connected to this row signal electrode Di. A plurality of analog switches 6-i (i=1,2,3, - - - ) are associated with a horizontal shift register 7 to form a row signal electrode drive circuit 8. Each line scanning electrode Gj is driven by a line scanning electrode drive circuit 9. The row signal electrode drive circuit 8 and the line scanning electrode drive circuit 9 are disposed along the sides of the light modulating section.

More specifically, in the row signal electrode drive circuit 8, the horizontal shift register 7 is activated in response to a horizontal reset signal (i.e., HRST) and a horizontal shift clock (i.e., HCLK) sent from a drive timing pulse generating circuit (not shown). The activated horizontal shift register 7 successively turns on and off analog switches 6-i (i=1,2,3, - - - ) to supply a video signal Sig of each horizontal scanning period to a corresponding row signal electrode Di.

The line scanning electrode drive circuit 9 is formed by a vertical shift register which is activated in response to a vertical reset signal (i.e., VRST) and a vertical shift clock (i.e., VCLK) entered from the drive timing pulse generating circuit (not shown). The activated vertical shift register successively applies a select pulse to each line scanning electrode Gj to successively turn on each switching transistor 1 for one horizontal scanning period.

Accordingly, the video signal supplied to the row signal electrode Di charges the auxiliary capacitor 2 via the switching transistor 1 connected to a currently selected line scanning electrode Gj. The electrical potential (i.e., the voltage) of the pixel electrode 3 varies in accordance with the charging of the auxiliary capacitor 2. Thus, each pixel region of the liquid crystal 5 is independently activated in response to the voltage of the pixel electrode 3 so as to realize a pixel-by-pixel modulation of the reading light irradiated to the light modulating section.

FIG. 9 shows the relationship between horizontal scanning signals (1,2,3, - - - ) included in the video signal Sig of the non-interlaced scanning type (i.e., the ordered scanning type) and application of the selection pulse to each line scanning electrode Gj (i=1,2,3, - - - N) in the line scanning electrode drive circuit 9.

As apparent from FIG. 9, to realize the AC driving of the liquid crystal element 5, the polarity of the video signal Sig is alternately inverted in synchronism with the start timing of each vertical scanning period (i.e., frame period) so that the video signal Sig has opposed electrical potentials with respect to a predetermined reference potential between two neighboring vertical scanning periods. Respective line scanning electrodes Gj (i=1,2,3, -) are successively turned on in response to the selection pulse corresponding to each horizontal scanning period. Each pixel signal is supplied to each row signal electrode Di by closing the corresponding analog switch 6-i during the turning-on duration of each line scanning electrode Gj.

As a result, the light modulating section forms the frame video at the end of each vertical scanning period, so as to obtain the projection light of the pixel-by-pixel modulated frame video.

As described above, the liquid crystal display apparatus forms the frame video based on the video signal Sig of the non-interlaced scanning type. In other words, it was difficult to realize the similar video display by performing the horizontal scanning of the video signal of the interlaced scanning type (i.e., the jump-over scanning type). This is because the AC driving of approximately 30 Hz is definitely necessary for activating the liquid crystal, as understood from FIG. 9 wherein the polarity of the video signal Sig is inverted in synchronism with the start timing of each vertical scanning period.

However, Japanese Patent No. 7-32473 (publication of the examined patent application) discloses a liquid crystal display apparatus capable of realizing a high-quality video display by using the video signal of the interlaced scanning type. According to this prior art, the activating method of the line scanning electrodes is characteristic.

FIG. 10 shows a fundamental arrangement of the liquid crystal display apparatus disclosed in Japanese Patent No. 7-32473. Both the light modulating section and the row signal electrode drive circuit 8 are formed in the same manner as those disclosed in FIG. 9. However, a line scanning electrode drive circuit 10 is formed by a vertical shift register whose stage number is approximately a half of the total display line number. Output terminals of the line scanning electrode drive circuit 10 are connected to the odd-number line scanning electrodes Gj (j=1,3,5, - - - ). There are a plurality of analog switches 11-p (p=1,2,3, - - --), each selectively connecting an even-number line scanning electrode Gj (j=2,4,6, - - - ) to one of two neighboring odd-number line scanning electrodes Gj (j=1,3,5, - - - ) in synchronism with the start timing of each field period.

According to this apparatus, the switching of the analog switch 11-p (p=1,2,3, - - - ) is performed in response to the video signal Sig of the interlaced scanning type. More specifically, a switching control signal O/E (i.e., odd/even field signal) is supplied to each analog switch 11-p in synchronism with the start timing of each field period. Each analog switch 11-p is connected to a stationary terminal "a" when the field is an odd-number field and connected to another stationary terminal "b" when the field is an even-number field. As shown in FIG. 11, in the odd-number field, the video signals (1,3,5, - - - ) of the odd-number horizontal lines are successively written to the pixel electrodes 3 of the corresponding odd-number lines as well as the next even-number lines. The video signal of each odd-number horizontal line is thus written to two pixel electrodes 3 of the corresponding odd-number line and the next even-number line. In the even-number field, the video signals (2,4,6, - - - ) of the even-number horizontal lines are successively written to the pixel electrodes 3 of the corresponding even-number lines as well as the next odd-number lines. The video signal of each even-number horizontal line is thus written to two pixel electrodes of the corresponding even-number line and the next odd-number line.

Accordingly, in the odd-number field, each odd-number line scanning electrode $G_j$ (=1,3,5, - - - ) and the next even-number line scanning electrode $G_{i+}$(j=1,3,5, - - - ) are combined as a set of two neighboring line scanning electrodes receiving the same video signal "j" (j=1,3,5, - - - ) of the odd-number horizontal line. In the even-number field, each even-number line scanning electrode $G_j$ (j=2,4,6, - - - ) and the next odd-number line scanning electrode $G_{i+1}$ (j=2, 4,6, - - - ) are combined as another set of two neighboring line scanning electrodes receiving the same video signal "j" (j=2,4,6, - - - ) of the even-number horizontal line. When compared between the odd-number field and the even-number field, the writing of the video signal is performed by shifting one line in the vertical direction.

Furthermore, to realize the AC driving of the liquid crystal element 5, the polarity of the video signal Sig is alternately inverted in synchronism with the start timing of every field period so that the video signal Sig has opposed electrical potentials with respect to a predetermined reference potential between two neighboring fields.

However, according to the active matrix type liquid crystal display apparatus shown in FIGS. 8 and 9, when the video signal Sig is supplied in accordance with the non-interlaced scanning, its horizontal frequency is relatively large compared with the video signal of the interlaced scanning type. The drive frequency of the row signal electrode drive circuit 8 increases correspondingly. This is disadvantageous especially when the liquid crystal display apparatus displays the high-quality video signal whose pixel number is large.

To reduce the substantial drive frequency, the horizontal line video signal may be modified into multi-phase parallel signals to process each signal in a divided horizontal shift register. However, increasing the phase number will require size-enlarged peripheral circuits. This will increase the manufacturing costs of hardware components.

On the other hand, according to the liquid crystal display apparatus shown in FIGS. 10 and 11, the video signal Sig is limited to the interlaced scanning type. Thus, this apparatus cannot be applied to the video signal of the non-interlaced scanning type.

Furthermore, in the above-described conventional liquid crystal display apparatuses, the line scanning electrodes Gj (j=1,2,3, - - - ) and the row signal electrodes Di (i=1,2,3, - - - ) are thin leads pattern printed on a substrate. Accordingly, they have a wiring resistance and a related stray capacitance.

FIG. 12 shows an equivalent circuit showing the line scanning electrode Gj connected to corresponding active elements of the pixel portions. In FIG. 12, Rg represents the wiring resistance and Cg represents a composite capacitance. In this case, the composite capacitance Cg includes the gate capacitance of the switching transistor 1 in addition to the stray capacitance of the lead. In view of the overall electric characteristics, the connecting circuit of the line scanning electrode Gj can be regarded as a RC distributed constant circuit.

When the active matrix circuit is formed on a monocrystalline silicon substrate or a glass substrate by a thin film process, the wiring of each line scanning electrode Gj is generally formed by the polycrystalline silicon process. The sheet resistance is generally in the range from 1 to 100 (Ω·cm). When the liquid crystal display apparatus has an increased number of pixels, the wiring length is correspondingly increased. This significantly enlarges the ratio of the wiring length to the wiring width to a higher level where the influence of the wiring resistance is not negligible.

FIG. 13 shows a waveform of the select pulse applied to the line scanning electrode Gj shown in the equivalent circuit (FIG. 12). In FIG. 13, "P" represents the waveform of the select pulse at a portion located near the line scanning electrode drive circuit 10, and "Q" represents the waveform of the select pulse at a portion located far from the line scanning electrode drive circuit 10.

As understood from FIG. 13, the waveform of the select pulse becomes dull by the influence of the RC distributed constant circuit defined by the wiring resistance Rg and the composite capacitance Cg. The influence of the RC distributed constant circuit is roughly proportional to the distance from the output terminal of the line scanning electrode circuit 10. In the worst case, the peak level of the select pulse will be reduced by an amount of ΔVG as shown in FIG. 13.

FIGS. 14A through 14C show the writing operation of the video signal to a "j" line pixel electrode 3. FIG. 14A shows the waveform of the video signal Sig supplied to the pixel electrode 3 connected to the "j" line scanning electrode Gj. The polarity of the video signal Sig is inverted at the intervals of the field period to realize the AC driving of the liquid crystal 5. FIG. 14B shows the waveform of the select pulse applied to the "j" line scanning electrode Gj. The switching transistor 1 is turned on during one horizontal scanning period where the select pulse is in a H-level. FIG. 14C shows the pixel voltage Vpix written to the pixel electrode 3 via the switching transistor 1. The writing operation is performed for one horizontal scanning period in response to the application of the select pulse to the corresponding line scanning electrode Gj.

To perform the writing operation, the charging or discharging of the auxiliary capacitor 2 and the liquid crystal 5 is controlled by the switching transistor 1. In this case, if the select pulse has a reduced peak level, it will be impossible to receive a sufficient amount of current from the switching transistor 1. The writing operation of the pixel signal cannot be satisfactorily performed during one horizontal scanning period.

SUMMARY OF THE INVENTION

In view of the foregoing problems, the present invention has an object to provide an active matrix type liquid crystal display apparatus capable of solving the above-described problems and realizing the high-quality video display.

In order to accomplish the above and other related objects, one aspect of the present invention provides an active matrix type liquid crystal display apparatus, comprising a plurality of row signal electrodes having the row number corresponding to the pixel number of one horizontal scanning, a plurality of line scanning electrodes having the line number corresponding to the horizontal scanning line number of one vertical scanning, a plurality of active element portions formed at respective intersections of the row signal electrodes and the line scanning electrodes, each having a switching element being on/off controlled in response to a vertical scanning signal applied to one of the line scanning electrodes and having a pixel electrode to which a pixel signal is written from one of the row signal electrodes via the switching element, row signal electrode driving means for successively applying the pixel signal to each of the row signal electrodes, line scanning electrode driving means for successively applying the vertical scanning signal to each of the line scanning electrodes, a common electrode substrate facing a pixel electrode region where pixel electrodes are disposed, and a liquid crystal layer sealed in a space between the common electrode substrate and the pixel electrode region.

A memory means is provided for storing video signals of at least one horizontal scanning line.

A scanning method conversion means is provided for converting an entered video signal of a non-interlaced scanning type (i.e., the ordered scanning type) into a video signal of an interlaced scanning type (i.e., the jump-over scanning type) by alternately selecting odd-number horizontal scanning line signals and even-number horizontal scanning line signals in synchronism with the start timing of each vertical scanning period.

A polarity inversion means is provided for alternately inverting the polarity of the video signal obtained from the scanning method conversion means in synchronism with the start timing of each vertical scanning period.

And, a vertical scanning control means is provided for controlling the line scanning electrode driving means to successively applying the vertical scanning signal to each set of two neighboring line scanning electrodes in synchronism with the start timing of each horizontal scanning period of the video signal converted by the scanning method conversion means, the two neighboring line scanning electrodes in each set being shifted by one line in a next vertical scanning period.

With this arrangement, the video signal of the non-interlaced scanning type is converted into the video signal of the interlaced scanning type by alternately selecting odd-number horizontal scanning line signals or even-number horizontal scanning line signals in synchronism with the start timing of each vertical scanning period. The polarity of the video signal is inverted every vertical scanning period. During a first vertical scanning period, the odd-number video signal is written to respective sets of two neighboring line scanning electrodes. During a second vertical scanning period, the even-number video signal is written to another sets of two neighboring line scanning electrodes. The time axis of each horizontal scanning period is doubled. The drive frequency of a row signal electrode drive circuit is halved.

Another aspect of the present invention provides an active matrix type liquid crystal display apparatus, comprising a plurality of row signal electrodes having the row number corresponding to the pixel number of one horizontal scanning, a plurality of line scanning electrodes having the line number corresponding to the horizontal scanning line number of one vertical scanning, a plurality of active element portions formed at respective intersections of the row signal electrodes and the line scanning electrodes, each having a switching element being on/off controlled in response to a vertical scanning signal applied to one of the line scanning electrodes and having a pixel electrode to which a pixel signal is written from one of the row signal electrodes via the switching element, row signal electrode driving means for successively applying the pixel signal to each of the row signal electrodes, line scanning electrode driving means for successively applying the vertical scanning signal to each of the line scanning electrodes, a common electrode substrate facing a pixel electrode region where pixel electrodes are disposed, and a liquid crystal layer sealed in a space between the common electrode substrate and the pixel electrode region.

A memory means is provided for storing video signals of at least a ½ frame.

A scanning method conversion means is provided for converting an entered video signal of a non-interlaced scanning type into a video signal of an interlaced scanning type by selecting even-number horizontal scanning line signals of an "n−1" frame and odd-number horizontal scanning line signals of an "n" frame during a first vertical scanning period and then selecting odd-number horizontal scanning line signals of the "n" frame and even-number horizontal scanning line signals of an "n+1" frame during a second vertical scanning period succeeding the first vertical scanning period.

A polarity inversion means is provided for alternately inverting the polarity of the video signal obtained from the scanning method conversion means in synchronism with the start timing of each half of the vertical scanning period.

And, a vertical scanning control means is provided for controlling the line scanning electrode driving means to successively applying the vertical scanning signal to each set of two neighboring line scanning electrodes in synchronism with the start timing of each horizontal scanning period of the video signal converted by the scanning method conversion means, the two neighboring line scanning electrodes in each set being shifted by one line in respective ½ vertical scanning periods consisting of one vertical scanning period.

Furthermore, another aspect of the present invention provides an active matrix type liquid crystal display apparatus for realizing an AC driving of the liquid crystal by alternately inverting the polarity of a video signal of an interlaced scanning type in synchronism with the start timing of each vertical scanning period, the liquid crystal display comprising a plurality of row signal electrodes having the row number corresponding to the pixel number of one horizontal scanning, a plurality of line scanning electrodes having the line number corresponding to the horizontal scanning line number of one vertical scanning, a plurality of active element portions formed at respective intersections of the row signal electrodes and the line scanning electrodes, each having a switching element being on/off controlled in response to a vertical scanning signal applied to one of the line scanning electrodes and having a pixel electrode to which a pixel signal is written from one of the row signal electrodes via the switching element, row signal electrode driving means for successively applying the pixel signal to each of the row signal electrodes, line scanning electrode driving means for successively applying the vertical scanning signal to each of the line scanning electrodes, a common electrode substrate facing a pixel electrode region where pixel electrodes are disposed, and a liquid crystal layer sealed in a space between the common electrode substrate and the pixel electrode region.

A vertical scanning control means is provided for controlling the line scanning electrode driving means in such a manner that:

a set of 2N neighboring line scanning electrodes is selected simultaneously in each horizontal scanning period of a field period, where "N" is an integer equal to or larger than 2;

the combination of the 2N neighboring line scanning electrodes is shifted by two lines in a next horizontal scanning period of the field period;

a vertical scanning signal, whose width is N times the horizontal scanning period, is applied to the selected 2N neighboring line scanning electrodes, so that the end time of the vertical scanning signal coincides with the end timing of the horizontal scanning period; and the combination of the 2N neighboring line scanning electrodes is shifted by one line in a next field period.

BRIEF DESCRIPTION OF THE DRAWINGS

The above and other objects, features and advantages of the present invention will become more apparent from the following detailed description which is to be read in conjunction with the attached drawings, in which:

FIG. 1 is a block diagram showing the schematic arrangement of a liquid crystal display apparatus in accordance with a first embodiment of the present invention;

FIG. 4 is a signal timing chart illustrating the operation of the liquid crystal display apparatus in accordance with the second embodiment of the present invention;

DESCRIPTION OF THE PREFERRED EMBODIMENTS

Figure 2:
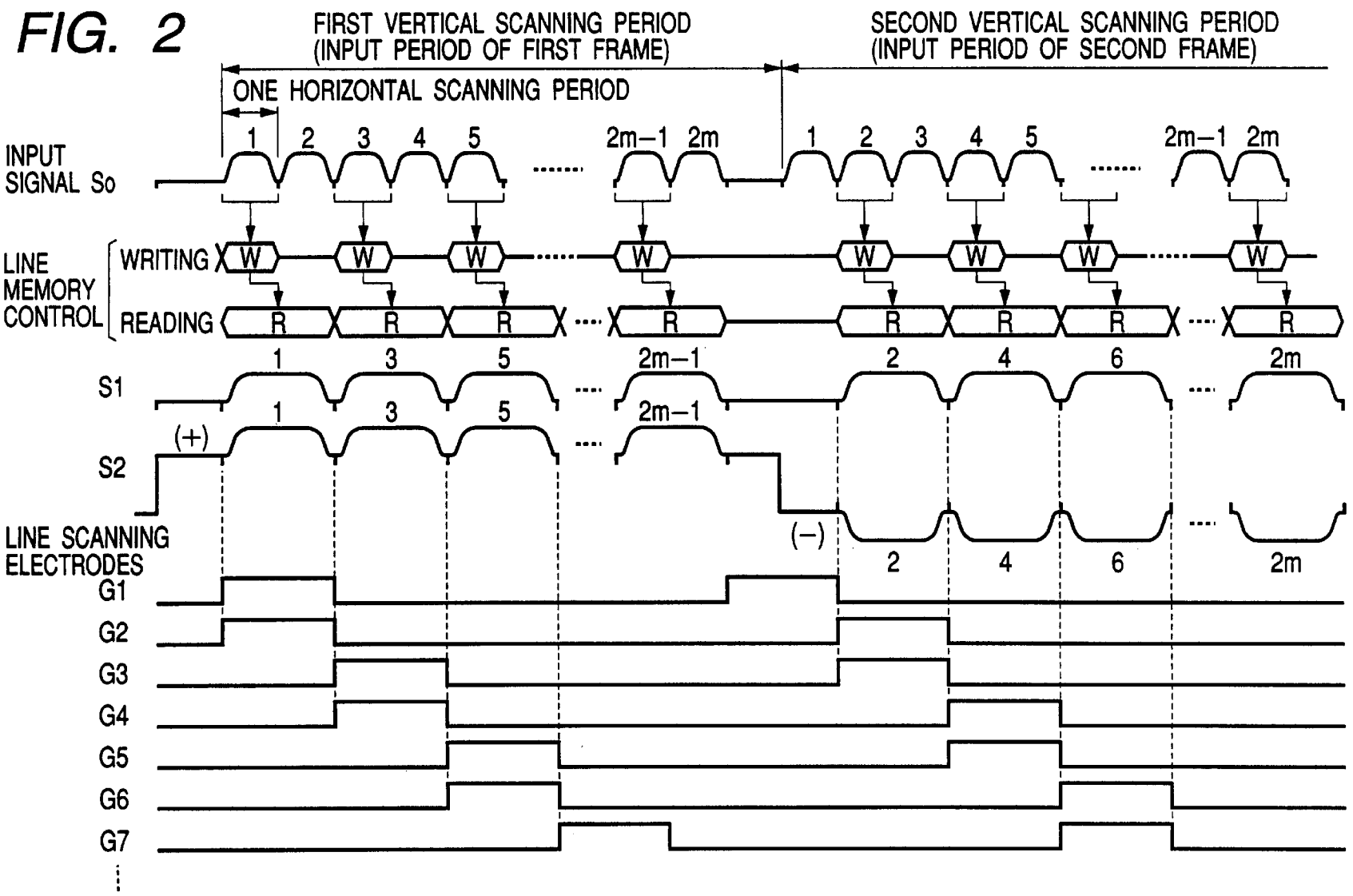
FIG. 2 is a signal timing chart illustrating the operation of the liquid crystal display apparatus in accordance with the first embodiment of the present invention.

Hereinafter, preferred embodiments of the present invention will be explained with reference to the attached drawings. Identical parts are denoted by the same reference numerals throughout the views.

First Embodiment

FIG. 1 shows the schematic arrangement of a liquid crystal display apparatus in accordance with a first embodiment of the present invention. In FIG. 1, a light modulating section 100 comprises a plurality of row signal electrodes Di (i=1,2,3, - - - ) and a plurality of line scanning electrodes Gj (j=1,2,3, - - - ) which are arranged in a matrix pattern on a substrate. An active element circuit, consisting of a switching transistor 1 and an auxiliary capacitor 2, is formed at respective intersections formed by the row signal electrodes Di and the line scanning electrodes Gj. Preferably, the switching transistor 1 is a MOS-FET or a TFT. A plane pixel electrode 3 is provided on each surface dissected by the row signal electrodes Di and the line scanning electrodes Gj. Each pixel electrode 3 is connected to a connecting point between the switching transistor 1 and the auxiliary capacitor 2 in each active element circuit.

Each pixel electrode 3 is a transparent electrode, such as an ITO (Indium Tin Oxide) electrode, for the transmission-type liquid crystal display apparatus, or a reflection layer, such as an Al (i.e., Aluminum) film, for the reflection-type liquid crystal display apparatus. A liquid crystal orientation film (not shown) is provided on the upper surface of the pixel electrode 3.

The liquid crystal orientation film and a common electrode film 4 are provided on a glass substrate (not shown), which is positioned in a confronting relationship with the substrate for the above-described active elements. A liquid crystal 5 is sealed tightly in a clearance space between these opposed substrates.

Each row signal electrode Di is connected to and driven by a row signal electrode drive circuit 8. Each odd-number line scanning electrode Gj (j=1,3,5, - - - ) is connected to and driven by an odd-number line scanning electrode drive circuit 10-1. Each even-number line scanning electrode Gj (j=2,4,6, - - - ) is connected to and driven by an even-number line scanning electrode drive circuit 10-2. The row signal electrode drive circuit 8 is disposed along one side of the light modulating section 100. Two line scanning electrode drive circuits 10-1 and 10-2 are disposed along opposed sides of the light modulating section 100.

The odd-number line scanning electrode drive circuit 10-1 operates in response to a vertical reset signal (i.e., VRST1) and a vertical shift clock (i.e., VCLK1). The even-number line scanning electrode drive circuit 10-2 operates in response to a vertical reset signal (i.e., VRST2) and a vertical shift clock (i.e., VCLK2).

Figure 8:
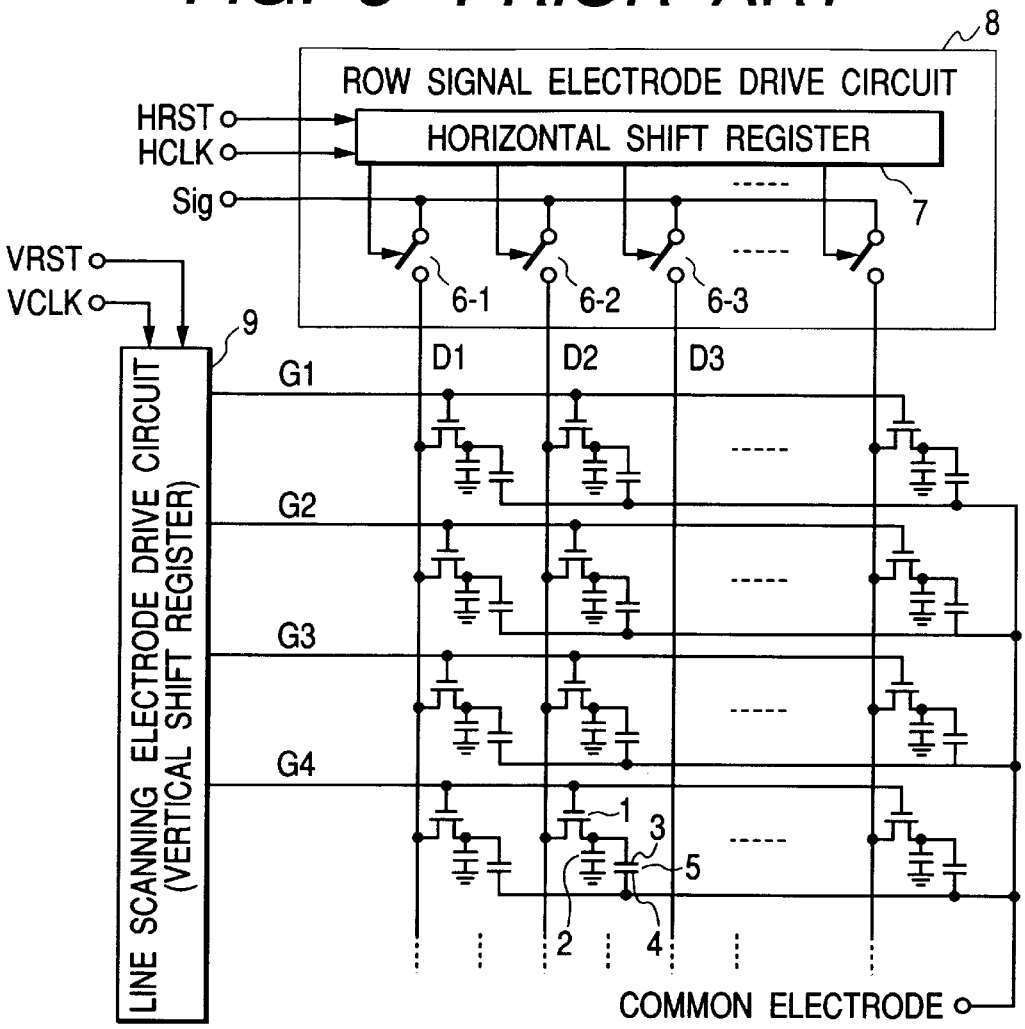
FIG. 8 PRIOR ART
FIG. 8 is a block diagram showing the schematic arrangement of a conventional liquid crystal display apparatus for displaying video signals of the non-interlaced scanning type.
Figure 9:
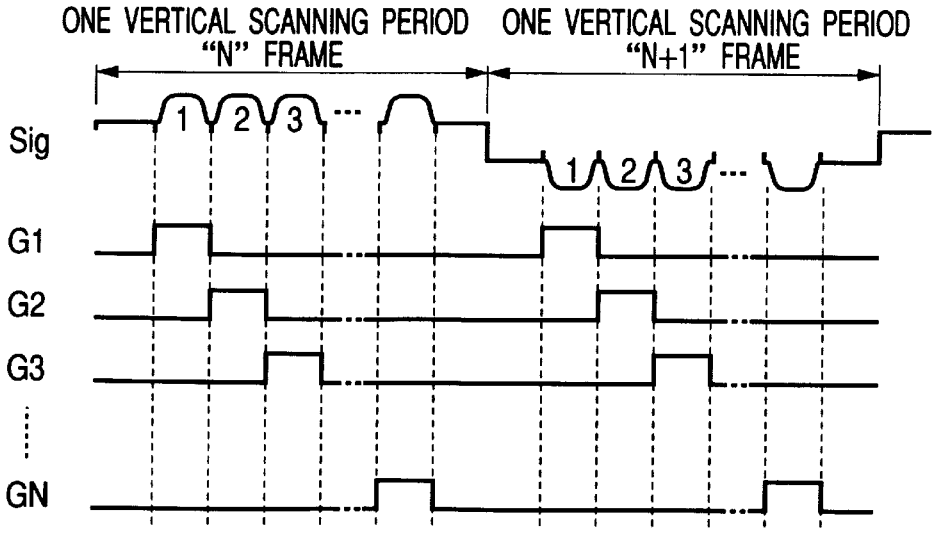
FIG. 9 PRIOR ART
FIG. 9 is a signal timing chart illustrating the operation of the conventional liquid crystal display apparatus shown in FIG. 8.
Figure 10:
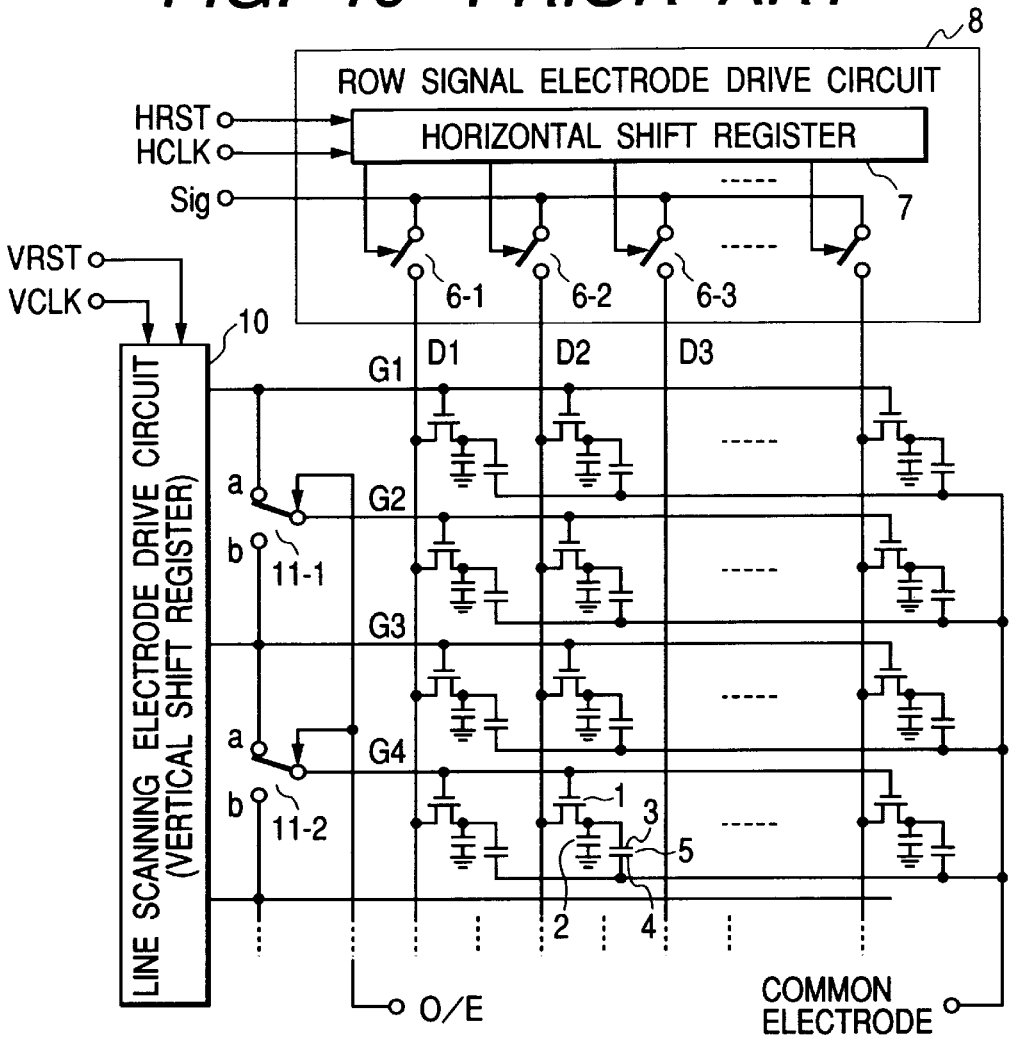
FIG. 10 PRIOR ART
FIG. 10 is a block diagram showing the schematic arrangement of another conventional liquid crystal display apparatus for displaying video signals of the interlaced scanning type.
Figure 11:
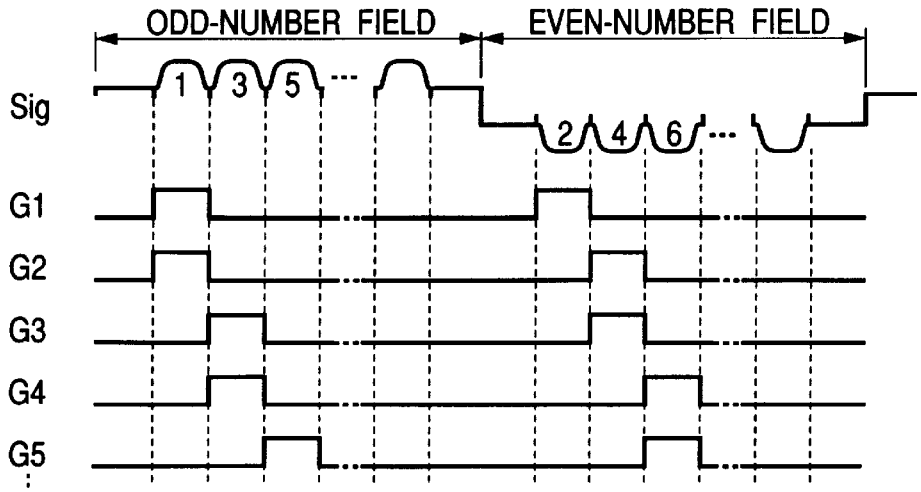
FIG. 11 PRIOR ART
FIG. 11 is a signal timing chart illustrating the operation of the conventional liquid crystal display apparatus shown in FIG. 10.
Figure 12:
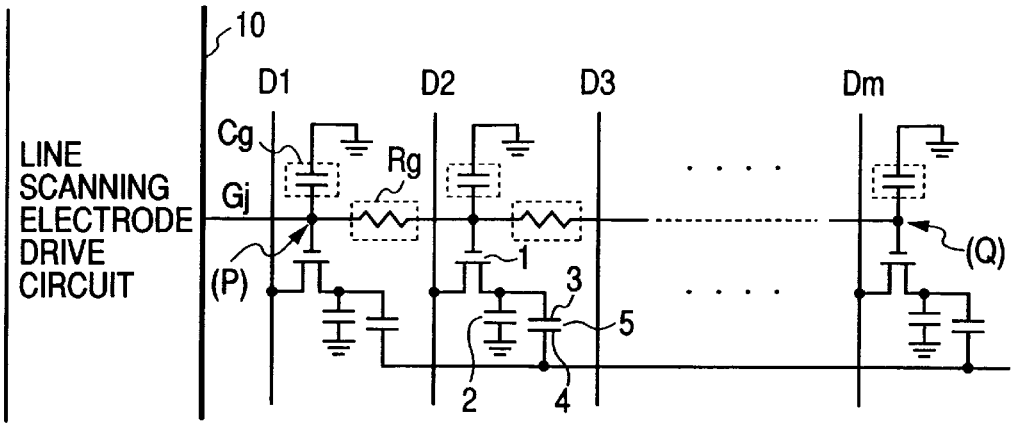
FIG. 12 PRIOR ART
FIG. 12 is an equivalent circuit of a conventional line scanning electrode and associated wiring of active elements of respective pixel portions.
Figure 13:
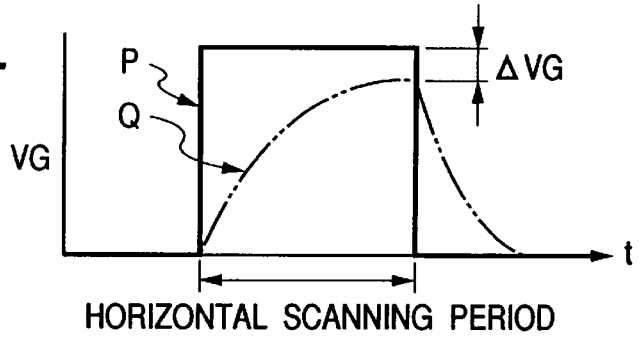
FIG. 13 PRIOR ART
FIG. 13 is a time chart showing the waveform of a select pulse applied to a line scanning electrode.
Figure 14A:
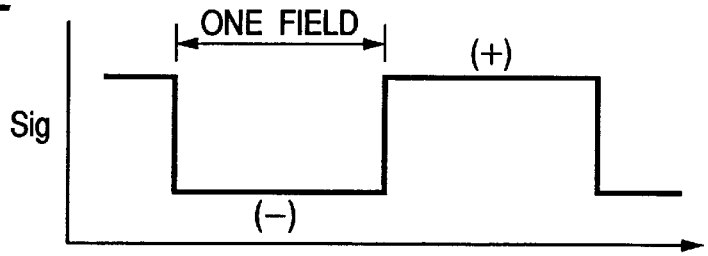
FIG. 14A PRIOR ART
FIGS. 14A to 14C are time charts illustrating the writing of a video signal to a pixel electrode.
Figure 14B:
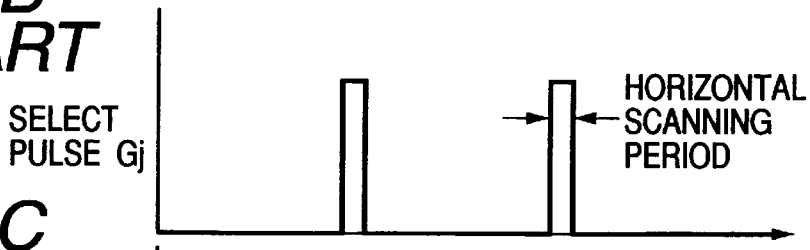
FIG. 14B PRIOR ART
Figure 14C:
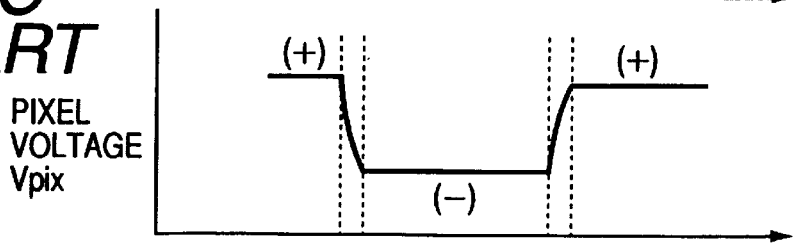
FIG. 14C PRIOR ART

The row signal electrode drive circuit 8 shown in FIG. 1 is structurally and functionally the same as that shown in FIGS. 8 and 10. The line scanning electrode drive circuits 10-1 and 10-2 shown in FIG. 1 cooperatively function substantially the same manner as the line scanning electrode drive circuit 10 and the associated analog switches 11-p (p=1,2,3, - - - ) shown in FIG. 10.

The liquid crystal display apparatus shown in FIG. 1 receives an original video signal So of the non-interlaced scanning type (i.e., the ordered scanning type). This liquid crystal display apparatus roughly comprises a signal input section 101 and a scanning control section 102. The signal input section 101 converts the received video signal into the video signal processible according to the interlaced scanning method (i.e., the jump-overscanning method) and inverts the polarity of the converted video signal for the AC driving of the liquid crystal. The modified video signal is sent to the row signal electrode drive circuit 8. The scanning control section 102 controls the row signal electrode drive circuit 8 and each of the line scanning electrode drive circuits 10-1 and 10-2.

More specifically, the signal input section 101 comprises an A/D converter 21, a 1-line memory 22, a D/A converter 23, and a polarity inversion circuit 24. The A/D converter 21 receives the original video signal So of the non-interlaced scanning type and converts it into digital data. The 1-line memory 22, connected to the A/D converter 21, stores the digital data of one horizontal scanning period sent from the A/D converter 21. The D/A converter 23, connected to the 1-line memory 22, reads the digital data stored in the 1-line memory 22 and converts them into an analog video signal S1. The polarity inversion circuit 24 inverts the polarity of the analog video signal S1 in synchronism with the start timing of each vertical scanning period so that the analog video signal S1 has opposed electrical potentials with respect to a predetermined reference potential between two neighboring vertical scanning periods.

Preferably, the 1-line memory 22 is a FIFO (first-in/first-out) memory capable of generating internal addresses. Alternatively, the 1-line memory 22 can be formed by combining an external-address supply type memory and an address generating circuit.

A memory control signal generating circuit 25 produces control signals (i.e., WRST, WCLK, WE/RRST, RCLK, RE) to the 1-line memory 22 to control the reading/writing operation of the 1-line memory 22. A sync processing circuit 26 supplies horizontal/vertical sync timing signals (i.e., H, V) to the memory control signal generating circuit 25 to realize the synchronized reading/writing operation.

The scanning control section 102 comprises a drive timing signal generating circuit 27 which supplies drive control signals (i.e., HRST, HCLK) to the row signal electrode drive circuit 8 in response to the horizontal/vertical sync timing signals (i.e., H, V) produced from the sync processing circuit 26. Furthermore, the drive timing signal generating circuit 27 supplies drive control signals (i.e., VRST1, VCLK1/VRST2, VCLK2) to the line scanning electrode drive circuits 10-1 and 10-2. The drive timing signal generating circuit 27 supplies an inversion timing signal (i.e., CLT) to the polarity inversion circuit 24. The polarity inversion circuit 24 performs the above-described polarity inversion operation in response to the inversion timing signal (i.e., CLT).

FIG. 2 is a timing chart illustrating the operation of the liquid crystal display apparatus shown in FIG. 1.

Each frame synchronism of the original video signal So of the non-interlaced scanning type is detected by the sync processing circuit 26. In FIG. 2, a first frame and a second frame are time sequential. Under the control of the memory control signal generating circuit 25, odd-number horizontal scanning signals (1,3,5, -, 2n−1) are written to the 1-line memory 22 in the first frame and even-number horizontal scanning signals (2,4,6, -, 2n) are written to the 1-line memory 22 in the second frame.

The reading control is performed at the half rate of the writing control. Accordingly, each horizontal scanning signal has a horizontal scanning period whose time axis is doubled. Thus, the D/A converter 23 produces the analog video signal S1 of the interlaced scanning type which lacks the even-number horizontal scanning signals when the frame period is the first frame and lacks the odd-number horizontal scanning signals when the frame period is the second frame. The analog video signal S1 is then sent to the polarity inversion circuit 24.

The polarity inversion circuit 24 converts the analog video signal S1 into a display video signal S2 whose polarity is inverted in synchronism with the start timing of each vertical scanning period (i.e., frame period). The display video signal S2 is then sent to a signal terminal of the row signal electrode drive circuit 8.

The display panel section 200, consisting of the light modulating section 100 and the electrode drive circuits 8, 10-1 and 10-2, performs the following scanning control in response to the entered video signal S2.

During a first vertical scanning period corresponding to the first frame, the display video signal S2 comprises odd-number horizontal scanning signals (1, 3, 5, - - - , 2m−1). In this first vertical scanning period, the line scanning electrode drive circuits 10-1 and 10-2 successively apply the select pulse to respective sets of two neighboring line scanning electrodes (G1, G2), (G3, G4), (G5, G6), - - - in response to the drive control signals (i.e., VRST1, VCLK1/VRST2, VCLK2) supplied from the drive timing signal generating circuit 27.

During a second vertical scanning period corresponding to the second frame, the display video signal S2 comprises even-number horizontal scanning signals (2, 4, 6, - - - , 2m). In this second vertical scanning period, the line scanning electrode drive circuits 10-1 and 10-2 successively apply the select pulse to another sets of two neighboring line scanning electrodes (G2, G3), (G4, G5), (G6, G7), - - - , which are shifted by one line from the above-described sets, in response to the drive control signals (i.e., VRST1, VCLK1/VRST2, VCLK2) supplied from the drive timing signal generating circuit 27.

Accordingly, during the first vertical scanning period, the odd-number horizontal scanning signals (1), (3), (5), - - - of the first frame are respectively written to the pixel electrodes 3 corresponding to the respective sets of two neighboring line scanning electrodes (G1, G2), (G3, G4), (G5,G6), - - - . During the second vertical scanning period, the even-number horizontal scanning signals (2), (4), (6), - - - of the second frame are respectively written to the pixel electrodes 3 corresponding to the other sets of two neighboring line scanning electrodes (G2, G3), (G4, G5), (G6, G7), - - - . In this manner, the same horizontal scanning signal is written to two neighboring line scanning electrodes in each vertical scanning period. When the odd-number horizontal scanning signals are written in a certain vertical scanning period, the even-number horizontal scanning signals are written in the next vertical scanning period by shifting one line.

As a result, the first embodiment provides the liquid crystal display apparatus capable of converting the original video signal So of the non-interlaced scanning type into the display video signal S2 of the interlaced scanning type. Furthermore, as described above, the time axis of each horizontal scanning period is doubled. This is effective to reduce the drive frequency of the row signal electrode drive circuit.

Furthermore, the above-described scanning control method realizes the AC driving of the liquid crystal without being disturbed by the flicker and also adequately maintains the display resolution in the vertical direction.

Second Embodiment

Figure 3:
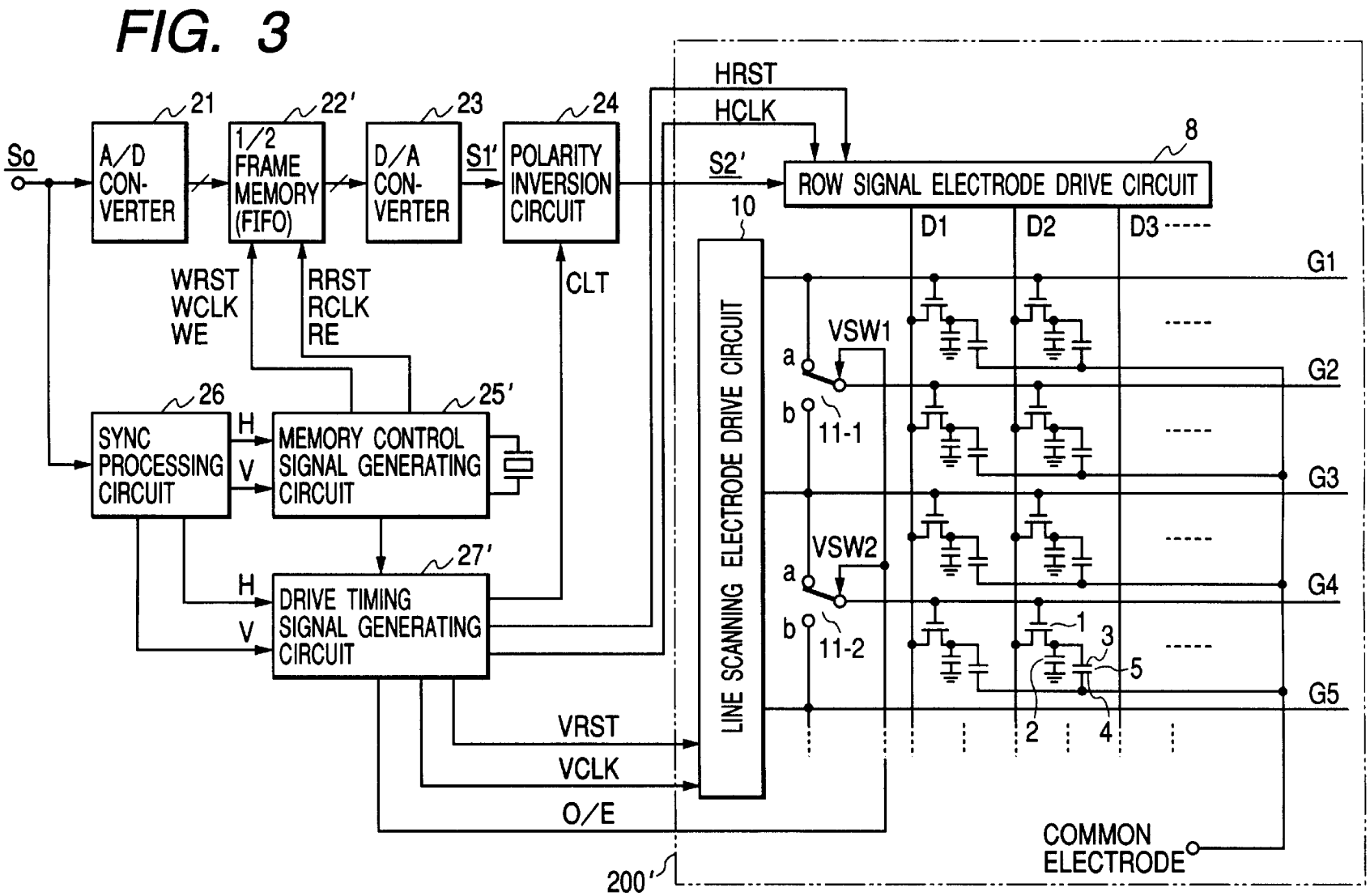
FIG. 3 is a block diagram showing the schematic arrangement of a liquid crystal display apparatus in accordance with a second embodiment of the present invention.

FIG. 3 shows the schematic arrangement of a liquid crystal display apparatus in accordance with a second embodiment of the present invention. The system arrangement shown in FIG. 3 is similar to the system arrangement shown in FIG. 1, but differs in the following points.

The 1-line memory 22 is replaced by a ½ frame memory (FIFO) 22'. Two independent line scanning electrode drive circuits 10-1 and 10-2 are replaced by a single line scanning electrode drive circuit 10 and associated analog switches 11-p (p=1,2,3, - - - ) which are substantially the same as those disclosed in FIG. 10. The single line scanning electrode drive circuit 10 and the analog switches 11-p cooperatively function to drive the odd-number line scanning electrodes G1, G3, G5, - - - .

A memory control signal generating circuit 25' and a drive timing signal generating circuit 27' produce various control signals at predetermined intervals or timings different from those of the memory control signal generating circuit 25 and the drive timing signal generating circuit 27 disclosed in FIG. 1. The drive timing signal generating circuit 27' supplies control signals (i.e., VRST, VCLK) to the line scanning electrode drive circuit 10, and supplied a switching control signal (O/E) to each analog switch 11-p.

FIG. 4 is a timing chart illustrating the operation of the liquid crystal display apparatus shown in FIG. 3.

The A/D converter 21 receives the original video image So of the non-interlaced scanning type and converts it into digital data. The obtained digital data is written in the ½ frame memory 22' in response to write control signals (i.e., WRST, WCLK, WE) produced from the memory control signal generating circuit 25'. In the n frame, only odd-number horizontal scanning signals are written to the ½ frame memory 22'. In the (n+1) frame, only even-number horizontal scanning signals are written to the ½ frame memory 22'. In other words, the video signal consisting of only the odd-number horizontal scanning signals and the video signal consisting of only the even-number horizontal scanning signals are alternately stored in the ½ frame memory 22' at the internals of the frame period.

The ½ frame memory 22' also functions as a buffer memory in the reading control. The reading control is performed at the same rate as that of the writing control.

The writing of the odd-number or even-number horizontal scanning line data of one frame is performed. When a half of this writing operation is completed, the reading operation is started from the head of the written horizontal scanning line data. When the writing operation of this frame is entirely finished, the reading operation is finished at the same timing. Then, the same data is again readout when the next frame is started.

It is assumed that the data writing period of odd-number or even-number horizontal scanning lines to the ½ frame memory 22' is substantially identical with one vertical scanning period of a display panel section 200'. In a certain vertical scanning period, scanning line data of an "n+1" frame are written to the ½ frame memory 22'. In this case, odd-number horizontal scanning line data of an "n" frame are successively read out and subsequently the even-number horizontal scanning line data of the "n+1" frame are successively read out.

The D/A converter 23 converts the readout data into an analog signal S1'. The analog signal S1' is then sent to the polarity inversion circuit 24 to invert the analog signal S1' with respect to the reference potential. The drive timing signal generating apparatus 27' sends the inversion timing signal (CLT) to the polarity inversion circuit 24 at the intervals equivalent to a half of the vertical scanning period.

The display video signal S2' is entered into the row signal electrode drive circuit 8. During the writing operation of the (n+1) frame, the odd-number horizontal scanning line data of the "n" frame is read out in the first half of the corresponding vertical scanning period (i.e., T2 period) and the even-number horizontal scanning line data of the (n+1) frame is read out in the second half of the corresponding vertical scanning period (i.e., T3 period). The polarities of the display video signal S2' in the first half and the second half of the same vertical scanning period are mutually opposed, as shown in FIG. 4.

Table 1 summarizes the details of the display video signal S2' entered to the row signal electrode drive circuit 8.

TABLE 1

| | display video signal S2' | polarity |
|---|---|---|
| T1 period | odd-number horizontal scanning lines of "n" frame | plus |
| T2 period | odd-number horizontal scanning lines of "n" frame | minus |
| T3 period | even-number horizontal scanning lines of "n+1", frame | plus |
| T4 period | even-number horizontal scanning lines of "n+1" frame | minus |

On the other hand, the display panel section 200' performs the following scanning control based on the control signals (i.e., HRST, HCLK and VRST, VCLK and O/E) produced from the drive timing signal generating circuit 27'.

In response to the switching control signal O/E, each analog switch 11-p (p=1,2,3, - - - ) is connected to the stationary terminal "a" during the "T1" and "T2" periods where the odd-number horizontal scanning line signals are written and is connected to the stationary terminal "b" during the "T3" and "T4" periods where the even-number horizontal scanning line signals are written.

As a result, during the "T1" period, the video signal S2' of the odd-number horizontal scanning lines of the "n" frame (polarity; +) is written to the pixel electrodes 3 connected to the respective sets of two neighboring line scanning electrodes (G1, G2), (G3, G4), (G5, G6), - - - . During the "T2" period, the video signal S2' of the odd-number horizontal scanning lines of the "n" frame (polarity; –) is written to the pixel electrodes 3 connected to the respective sets of two neighboring line scanning electrodes (G1, G2), (G3, G4), (G5, G6), - - - .

Furthermore, during the "T3" period, the video signal S2' of the even-number horizontal scanning lines of the "n+1" frame (polarity; +) is written to the pixel electrodes 3 connected to the another sets of two neighboring line scanning electrodes (G2, G3), (G4, G5), (G6, G7), - - - , which are shifted by one line from the above-described sets. During the "T4" period, the video signal S2' of the even-number horizontal scanning lines of the "n+1" frame (polarity; –) is written to the pixel electrodes 3 connected to the respective sets of two neighboring line scanning electrodes (G2, G3), (G4, G5), (G6, G7), - - - .

According to this arrangement, the original video signal So of the non-interlaced scanning type can be converted into the display video signal S2' of the interlaced scanning type. The AC driving frequency (i.e., polarity inversion frequency) of the liquid crystal can be doubled. The polarity switching in synchronism with each vertical scanning period can be performed by using the same pixel signal for each pixel. This realizes the excellent AC driving of the liquid crystal. Moreover, as the line scanning electrodes are combined as the above-described sets of two neighboring line scanning electrodes by shifting one line, the display resolution in the vertical direction can be adequately maintained.

Third Embodiment

Figure 5:
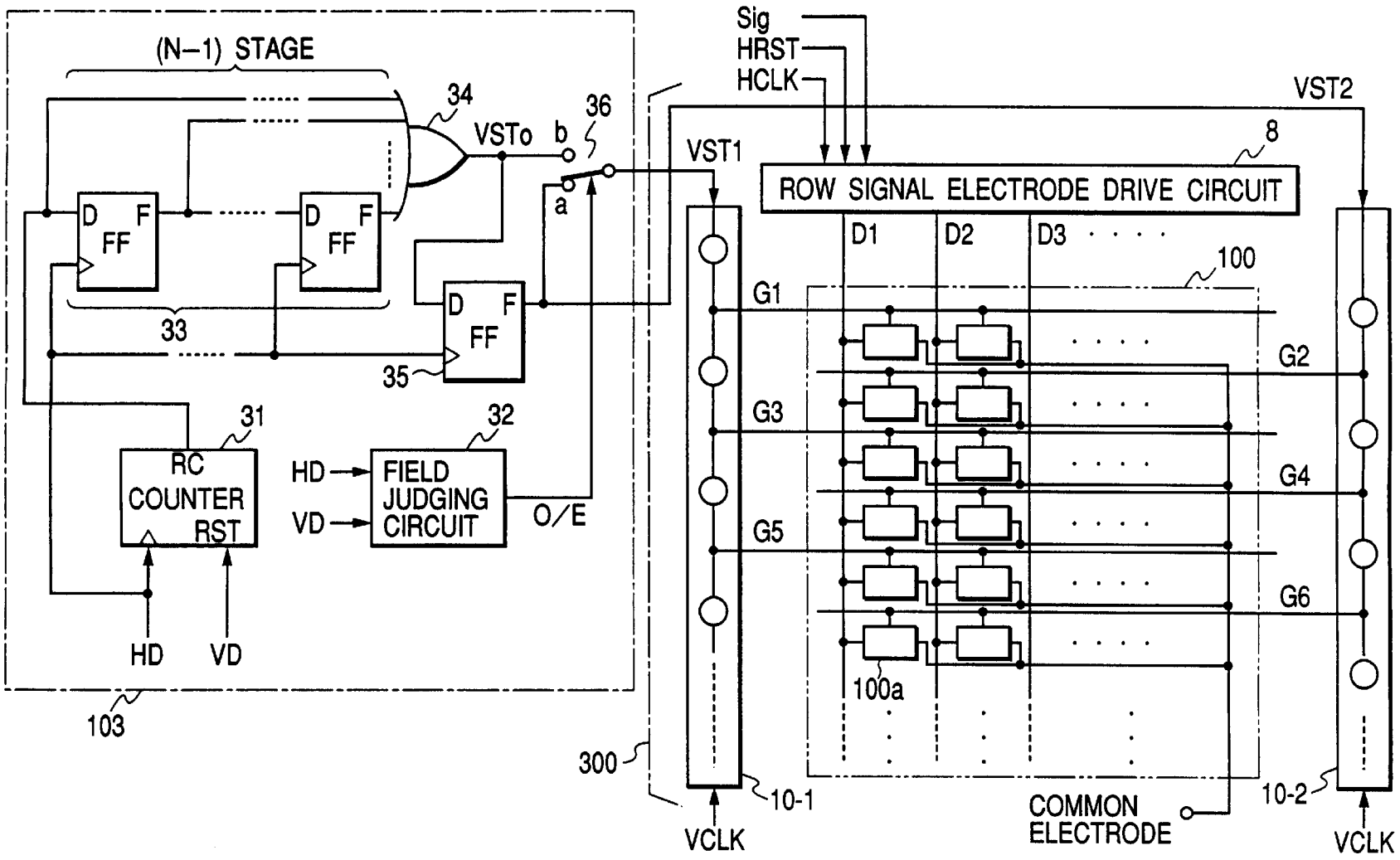
FIG. 5 is a block diagram showing the schematic arrangement of a liquid crystal display apparatus in accordance with a third embodiment of the present invention.

FIG. 5 shows the schematic arrangement of a liquid crystal display apparatus in accordance with a third embodiment of the present invention.

This liquid crystal display apparatus comprises a display panel section 300 and a vertical scanning control section 103. The display panel section 300 comprises a light modulating section 100, a row signal electrode drive circuit 8 and a pair of line scanning electrode drive circuits 10-1 and 10-2. The vertical scanning control section 103 controls the line scanning electrode drive circuits 10-1 and 10-2. This apparatus alternately inverts the polarity of a video signal Sig of the interlaced scanning type in synchronism with the start timing of every vertical scanning period to perform the video display based on the AC driving of the liquid crystal. The fundamental arrangement of the light modulating section 100 and the row signal electrode drive circuit 8 are substantially the same as those disclosed in the above-described embodiments. In the light modulating section 100, reference numeral 100*a* represents an active element circuit whose arrangement is already described in the foregoing description.

The line scanning electrode drive circuits 10-1 and 10-2 are disposed along the opposed sides of the light modulating section 100. One line scanning electrode drive circuit 10-1 actuates the odd-number line scanning electrodes Gj (j=1, 3, 5, - - - ) in response to a vertical start signal (i.e., VST1) and a vertical shift clock (i.e., VCLK). The other line scanning electrode drive circuit 10-2 actuates the even-number line scanning electrodes Gj (j=2, 4, 6, - - - ) in response to another vertical start signal (i.e., VST2) and the vertical shift clock (i.e., VCLK). The vertical shift clock has the same frequency as that of a horizontal sync signal.

The vertical scanning control circuit 103 comprises a counter 31, a field judging circuit 32, a shift register 33, an OR circuit 34, a delay circuit 35, and a switching circuit 36. The counter 31 counts the horizontal sync signal HD in response to the vertical sync signal VD serving as a reset signal. The field judging circuit 32 judges the input timing of odd-number fields and even-number fields to the row signal electrode drive circuit 8 based on the phase difference between the vertical sync signal VD and the horizontal sync signal HD. The shift register 33, consisting of serially connected D flip-flop (D-FF) circuits forming (N−1) stages, receives a ripple carrier signal RC of the counter 31 as an initial-stage input and receives the horizontal sync signal HD as a clock input. The numeral "N" is an integer equal to or larger than 2. The OR circuit 34 receives the ripple carrier signal RC of the counter 31 and output signals of respective D-FF circuits to obtain an OR result of the entered signals. The delay circuit 35, formed by a single D-FF circuit, delays the output of the OR circuit 34 by an amount equivalent to one horizontal scanning period. The delayed signal is sent to the line scanning electrode drive circuit 10-2. The switching circuit 36 selectively connects its movable contact to a stationary terminal "a" or to a stationary terminal "b" in response to the judging signal O/E produced from the field judging circuit 32. More specifically, the output of the delay circuit 35 is sent to the line scanning electrode drive circuit 10-1 in the odd-number field. The output of the OR circuit 34 is sent to the line scanning electrode drive circuit 10-1 in the even-number field.

According to this vertical scanning control circuit 103, the ripple carrier signal RC of the counter 31 has a pulse waveform whose pulse width (i.e., H-level period) is equal to one horizontal scanning period and whose repetition period is equal to the vertical scanning period. The pulse of the ripple carrier signal RC is successively transferred as an output of each D-FF from the first stage D-FF to the final (i.e., N−1) stage D-FF in synchronism with the horizontal sync signal HD entered as the clock input. The ripple carrier signal RC and the output signals of respective D-FF circuits are sent to the OR circuit 34. Thus, as a result of the OR operation, the OR circuit 34 produces an output signal VSTo whose pulse width (i.e., H-level period) is N times the horizontal scanning period.

The switching circuit 36 selectively switches its movable contact between the stationary terminals "a" and "b" in response to the judging signal O/E of the field judging circuit 32. In the odd-number field, the movable contact of the switching circuit 36 is connected to the stationary terminal "a" to send the output of the delay circuit 35 to the line scanning electrode drive circuit 10-1. In the even-number field, the movable contact of the switching circuit 36 is connected to the stationary terminal "b" to send the output of the OR circuit 34 to the line scanning electrode drive circuit 10-1.

Accordingly, in the odd-number field, the vertical start signals VST1 and VST2 entered in the line scanning electrode drive circuits 10-1 and 10-2 are in phase with each other. In the even-number field, the vertical start signal VST1 is phased advanced against the vertical start signal VST2 by an amount equivalent to one horizontal scanning period.

The line scanning electrode drive circuit 10-1 transfers the entered vertical start signal VST1 to the odd-number line scanning electrodes Gj (j=1, 3, 5, - - - ) in response to the vertical shift clock VCLK. The line scanning electrode drive circuit 10-2 transfers the entered vertical start signal VST2 to the even-number line scanning electrodes Gj (j=2, 4, 6, - - - ) in response to the vertical shift clock VCLK.

Figure 6:
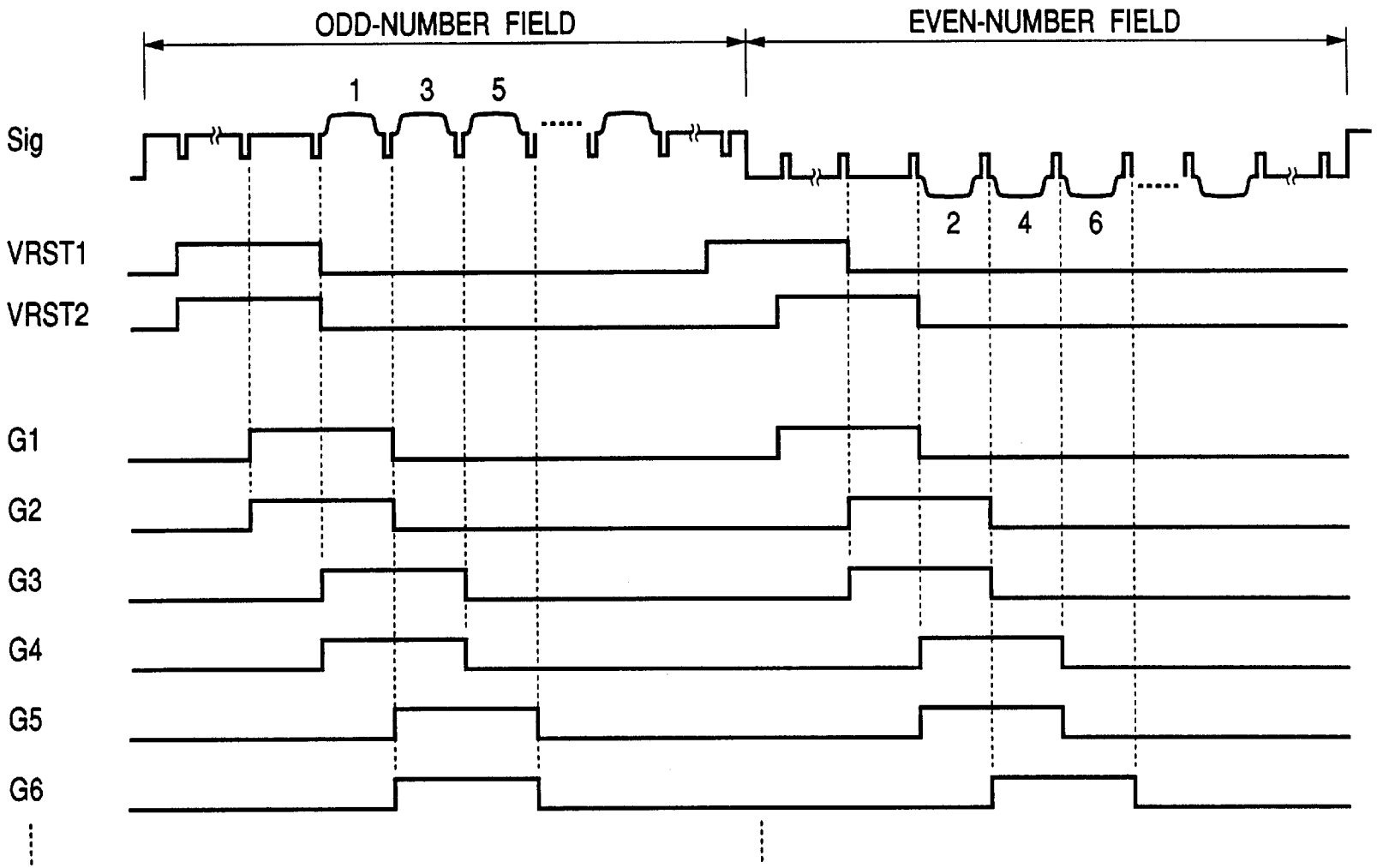
FIG. 6 is a signal timing chart illustrating the operation of the liquid crystal display apparatus in accordance with the third embodiment of the present invention.

FIG. 6 is a time chart showing the vertical start signals VRST1 and VRST2 and select pulses applied to the line scanning electrodes Gj (j=1,2,3,4, - - - ) during the odd-number field and the even-number field of the video signal Sig when the above-defined number "N" is 2.

The video signal Sig of the interlaced scanning type is the odd-number horizontal scanning signals in the odd-number field and the even-number horizontal scanning signals in the even-number field. The polarity of the video signal Sig is inverted in synchronism with the start timing of each field so as to realize the AV driving of the liquid crystal.

Based on the function and operation of the above-described vertical scanning control circuit 103, each of the vertical start signals VST1 and VST2 has the pulse width which is two times the horizontal scanning period. In the odd-number field, the vertical start signals VST1 and VST2 are in phase with each other. In the even-number field, the vertical start signal VST1 is phased advanced against the vertical start signal VST2 by an amount equivalent to one horizontal scanning period.

In each field period, the line scanning electrode drive circuits 10-1 and 10-2 independently transfer the vertical start signals VST1 and VST2 to the associated line scanning electrodes in synchronism with the start timing of each horizontal scanning period. Accordingly, in the odd-number field, four neighboring line scanning electrodes (G1, G2,G3, G4), (G3, G4, G5, G6), - - - are simultaneously selected in each horizontal scanning period. In the even-number field, four neighboring line scanning electrodes (G2, G3, G4, G5), (G4, G5, G6, G7), - - - are simultaneously selected in each horizontal scanning period.

As apparent from FIG. 6, the pulse width of the select pulse applied to each line scanning electrode Gj is two times the horizontal scanning period. Each select pulse is applied earlier than the writing start timing of each horizontal scanning signal by an amount equivalent to one horizontal scanning period. Furthermore, the four neighboring line scanning electrodes Gj selected simultaneously are shifted by one line between the odd-number field and the even-number field.

Through the above-described control of the line scanning electrodes Gj, the video signal is written to each pixel electrode 3 and held by the auxiliary capacitor 2 during one vertical scanning period.

As a result, according to the liquid crystal display apparatus of the third embodiment, a group of 2N neighboring line scanning electrodes Gj are simultaneously selected in every horizontal scanning period and the combination of the 2N neighboring line scanning electrodes Gj are changed in the next horizontal scanning period by shifting two lines. Thus, the select pulse applied to each line scanning electrode Gj is substantially extended (i.e., N times the horizontal scanning period). The application of the select pulse is advanced with respect to the writing start timing of each horizontal scanning signal by an amount equivalent to (N−1) times the horizontal scanning period. Thus, it becomes possible to assure the writing of the pixel signal to a corresponding pixel electrode without being influenced by the select pulse which may have an imperfect or dull pulse waveform.

Furthermore, as the combination of the 2N neighboring line scanning electrodes Gj is shifted by one line in the next field, the display resolution in the vertical direction can be adequately maintained.

Fourth Embodiment

Figure 7:
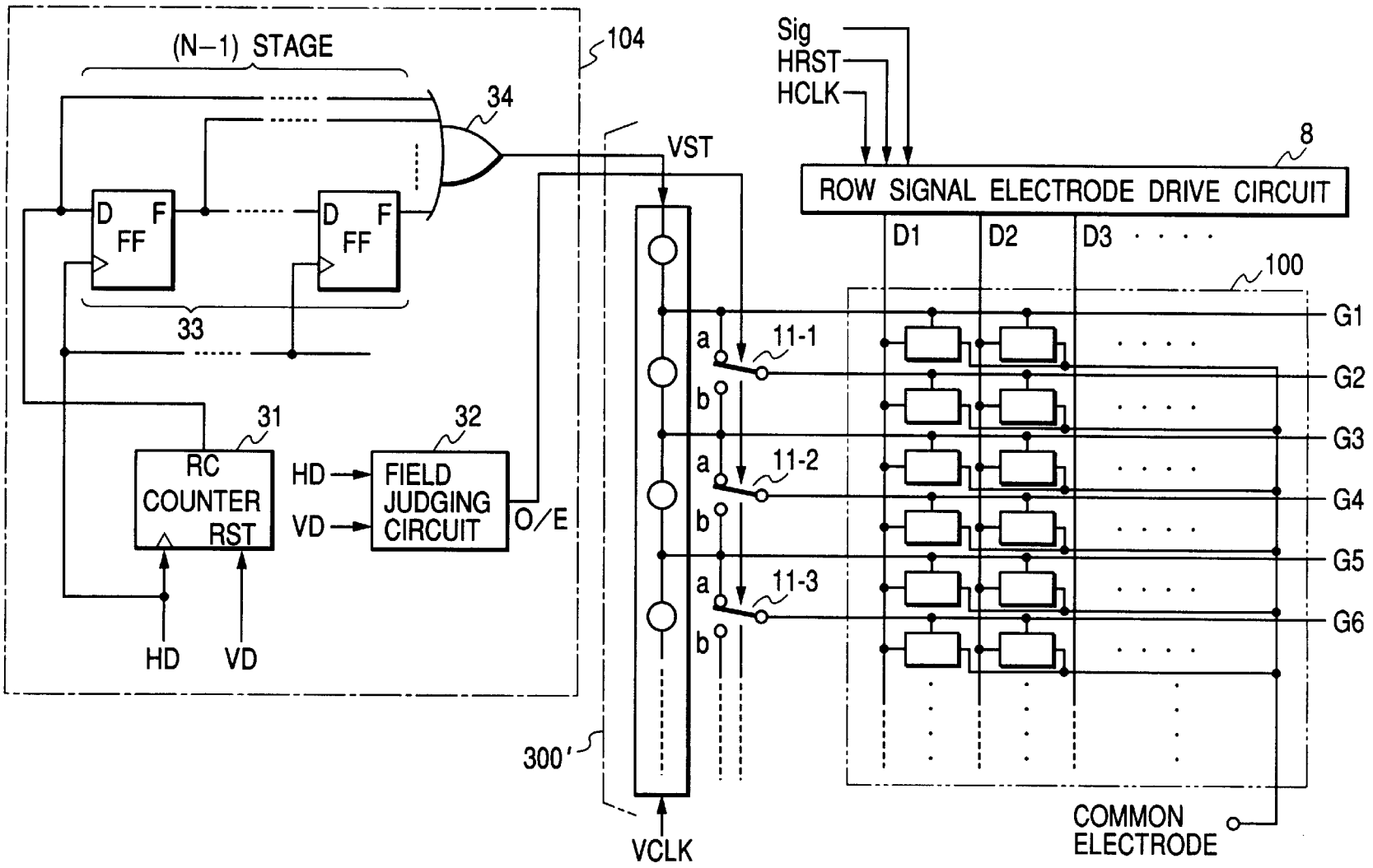
FIG. 7 is a block diagram showing the schematic arrangement of a liquid crystal display apparatus in accordance with a fourth embodiment of the present invention.

FIG. 7 shows the schematic arrangement of a liquid crystal display apparatus in accordance with a fourth embodiment of the present invention.

Both the light modulating section 100 and the row signal electrode drive circuit 8 are formed in the same manner as those disclosed in FIG. 5. However, a line scanning electrode drive circuit 10 is formed by a vertical shift register whose stage number is approximately a half of the total display line number. Output terminals of the line scanning electrode drive circuit 10 are connected to the odd-number line scanning electrodes Gj (j=1,3,5, - - - ). There are a plurality of analog switches 11-p (p=1,2,3, - - - ), each selectively connecting an even-number line scanning electrode Gj (j=2,4,6, - - - ) to one of two neighboring odd-number line scanning electrodes Gj (j=1,3,5, - - - ) in synchronism with the start timing of each field period.

The light modulating section 100, the row signal electrode drive circuit 8, and the line scanning electrode drive circuit 10 constitute a display panel section 300'.

A vertical scanning control circuit 104, connected to the display panel section 3001, sends a vertical start signal VST to the line scanning electrode drive circuit 10 and sends a switching control signal to each analog switch 11-p.

The vertical scanning control circuit 104 is similar to the vertical scanning control circuit 103 disclosed in the third embodiment but different in that the delay circuit 35 and the switching circuit 36 are omitted. The output signal of the OR circuit 34, serving as the vertical start signal VST, is directly sent to the line scanning electrode drive circuit 10. The judging signal O/E of the field judging circuit 32, serving as the switching control signal, is sent to each analog switch 11-p.

The OR circuit 34 produces the vertical start signal VST in synchronism with the start timing of each vertical scanning period. The pulse width (i.e., H-level period) of the vertical start signal VST is N times the horizontal scanning period. Each analog switch 11-p is connected to the stationary terminal "a" in response to each odd-number field and is connected to the stationary terminal "b" in response to each even-number field.

The vertical start signal VST is transferred in the line scanning electrode drive circuit 10. By the above-described switching operation of each analog switch 11-p, a group of 2N neighboring line scanning electrodes Gj are simultaneously selected in every horizontal scanning period and the combination of the 2N neighboring line scanning electrodes Gj are changed in the next horizontal scanning period by shifting two lines. Furthermore, as the combination of the 2N neighboring line scanning electrodes Gj is shifted by one line in the next field period, the display resolution in the vertical direction can be adequately maintained. Thus, the vertical scanning control is performed appropriately.

When the numeral N is 2, the select pulse is applied to each line scanning electrode Gj as shown in FIG. 6.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. An active matrix type liquid crystal display apparatus, comprising:

a plurality of row signal electrodes having the row number corresponding to the pixel number of one horizontal scanning;

a plurality of line scanning electrodes having the line number corresponding to the horizontal scanning line number of one vertical scanning;

a plurality of active element portions formed at respective intersections of said row signal electrodes and said line scanning electrodes, each having a switching element being on/off controlled in response to a vertical scanning signal applied to one of said line scanning electrodes and having a pixel electrode to which a pixel signal is written from one of said row signal electrodes via said switching element;

row signal electrode driving means for successively applying the pixel signal to each of said row signal electrodes;

line scanning electrode driving means for successively applying the vertical scanning signal to each of said line scanning electrodes;

a common electrode substrate facing a pixel electrode region where pixel electrodes are disposed;

a liquid crystal layer sealed in a space between said common electrode substrate and said pixel electrode region;

memory means for storing video signals of at least one horizontal scanning line;

scanning method conversion means for converting an entered video signal of a non-interlaced scanning type into a video signal of an interlaced scanning type by alternately selecting odd-number horizontal scanning line signals and even-number horizontal scanning line signals in synchronism with the start timing of each vertical scanning period;

polarity inversion means for alternately inverting the polarity of the video signal obtained from said scanning method conversion means in synchronism with the start timing of each vertical scanning period; and vertical scanning control means for controlling said line scanning electrode driving means to successively applying the vertical scanning signal to each set of two neighboring line scanning electrodes in synchronism with the start timing of each horizontal scanning period of the video signal converted by said scanning method conversion means, said two neighboring line scanning electrodes in each set being shifted by one line in a next vertical scanning period.

2. An active matrix type liquid crystal display apparatus, comprising:

a plurality of row signal electrodes having the row number corresponding to the pixel number of one horizontal scanning;

a plurality of line scanning electrodes having the line number corresponding to the horizontal scanning line number of one vertical scanning;

a plurality of active element portions formed at respective intersections of said row signal electrodes and said line scanning electrodes, each having a switching element being on/off controlled in response to a vertical scanning signal applied to one of said line scanning electrodes and having a pixel electrode to which a pixel signal is written from one of said row signal electrodes via said switching element;

row signal electrode driving means for successively applying the pixel signal to each of said row signal electrodes;

line scanning electrode driving means for successively applying the vertical scanning signal to each of said line scanning electrodes;

a common electrode substrate facing a pixel electrode region where pixel electrodes are disposed;

a liquid crystal layer sealed in a space between said common electrode substrate and said pixel electrode region;

memory means for storing video signals of at least a ½ frame;

scanning method conversion means for converting an entered video signal of a non-interlaced scanning type into a video signal of an interlaced scanning type by selecting even-number horizontal scanning line signals of an "n−1" frame and odd-number horizontal scanning line signals of an "n" frame during a first vertical scanning period and then selecting odd-number horizontal scanning line signals of the "n" frame and even-number horizontal scanning line signals of an "n+1" frame during a second vertical scanning period succeeding said first vertical scanning period;

polarity inversion means for alternately inverting the polarity of the video signal obtained from said scanning method conversion means in synchronism with the start timing of each half of the vertical scanning period; and vertical scanning control means for controlling said line scanning electrode driving means to successively applying the vertical scanning signal to each set of two neighboring line scanning electrodes in synchronism with the start timing of each horizontal scanning period of the video signal converted by said scanning method conversion means, said two neighboring line scanning electrodes in each set being shifted by one line in respective ½ vertical scanning periods consisting of one vertical scanning period.

3. An active matrix type liquid crystal display apparatus for realizing an AC driving of the liquid crystal by alternately inverting the polarity of a video signal of an interlaced scanning type in synchronism with the start timing of each vertical scanning period, said liquid crystal display comprising:

a plurality of row signal electrodes having the row number corresponding to the pixel number of one horizontal scanning;

a plurality of line scanning electrodes having the line number corresponding to the horizontal scanning line number of one vertical scanning;

a plurality of active element portions formed at respective intersections of said row signal electrodes and said line scanning electrodes, each having a switching element being on/off controlled in response to a vertical scanning signal applied to one of said line scanning electrodes and having a pixel electrode to which a pixel signal is written from one of said row signal electrodes via said switching element;

row signal electrode driving means for successively applying the pixel signal to each of said row signal electrodes;

line scanning electrode driving means for successively applying the vertical scanning signal to each of said line scanning electrodes;

a common electrode substrate facing a pixel electrode region where pixel electrodes are disposed;

a liquid crystal layer sealed in a space between said common electrode substrate and said pixel electrode region; and vertical scanning control means for controlling said line scanning electrode driving means in such a manner that:

a set of 2N neighboring line scanning electrodes is selected simultaneously in each horizontal scanning period of a field period, where "N" is an integer equal to or larger than 2;

the combination of said 2N neighboring line scanning electrodes is shifted by two lines in a next horizontal scanning period of said field period;

a vertical scanning signal, whose width is N times the horizontal scanning period, is applied to the selected 2N neighboring line scanning electrodes, so that the end time of said vertical scanning signal coincides with the end timing of the horizontal scanning period; and the combination of said 2N neighboring line scanning electrodes is shifted by one line in a next field period.

* * * * *